US006173768B1

(12) United States Patent
Watson

(10) Patent No.: US 6,173,768 B1
(45) Date of Patent: Jan. 16, 2001

(54) METHOD AND APPARATUS FOR DOWNHOLE OIL/WATER SEPARATION DURING OIL WELL PUMPING OPERATIONS

(75) Inventor: Brock W. Watson, Carrollton, TX (US)

(73) Assignee: Halliburton Energy Services, Inc., Dallas, TX (US)

( * ) Notice: Under 35 U.S.C. 154(b), the term of this patent shall be extended for 0 days.

(21) Appl. No.: 09/371,689

(22) Filed: Aug. 10, 1999

Related U.S. Application Data

(60) Provisional application No. 60/096,923, filed on Aug. 18, 1998, and provisional application No. 60/103,226, filed on Oct. 5, 1998.

(51) Int. Cl.[7] ..... E21B 34/14

(52) U.S. Cl. ..... 166/68; 166/105.5

(58) Field of Search ..... 166/105.5, 106, 166/265, 313, 372, 373, 68, 69

(56) References Cited

U.S. PATENT DOCUMENTS 4,026,661 * 5/1977 Roeder ..... 417/53
4,427,345 * 1/1984 Blann et al. ..... 417/54
5,988,275 * 11/1999 Brady et al. ..... 166/105.5
6,082,452 * 7/2000 Shaw et al. ..... 166/105.5
6,116,341 * 9/2000 Stuebinger et al. ..... 166/265

* cited by examiner

*Primary Examiner*—Frank Tsay
(74) *Attorney, Agent, or Firm*—Paul I. Herman; Marlin R. Smith

(57) ABSTRACT

The improved method and apparatus for down-hole oil/water separation during oil well pumping operations includes a conventional sucker rod pump disposed within a tubing string which may be disposed within the casing of a wellbore. The sucker rod pump may be releasably attached to a sucker rod at one end. A side intake valve may be disposed within the tubing string at a position down-hole from the sucker rod pump. A check valve may be located at an elevation above the injection perforations. The sucker rod may also be attached to a pumping jack at the surface of the wellbore. Production piping with an automatic control valve and a back pressure regulator may extend from the tubing string at the surface of the wellbore. A piping loop with a check valve disposed therein may also extend from the production piping terminating on opposite sides of the automatic control valve. In one embodiment, an accumulator may be coupled to the production piping between the back pressure regulator and the piping loop.

11 Claims, 5 Drawing Sheets

METHOD AND APPARATUS FOR DOWNHOLE OIL/WATER SEPARATION DURING OIL WELL PUMPING OPERATIONS

CROSS-REFERENCE TO RELATED APPLICATIONS

This application claims the benefit of the filing date of U.S. provisional application Ser. No. 60/096,923, filed Aug. 18, 1998, and U.S. provisional application Ser. No. 60/103,226, filed Oct. 5, 1998, the disclosures of which are incorporated herein by this reference.

TECHNICAL FIELD OF THE INVENTION

The present invention relates generally to equipment for the production of hydrocarbons and, more particularly, to a method and apparatus for downhole oil/water separation during oil well pumping operations.

BACKGROUND OF THE INVENTION

The production of underground hydrocarbons often requires substantial investment in drilling and pumping equipment. When production is underway, up-front costs can be recouped provided operating costs remain low enough for the sale of oil and/or gas to be profitable. One factor which significantly effects the operating costs of many wells is the amount of water present within the associated hydrocarbon producing formation. Many profitable wells become uneconomic because of excessive water production. Costs involved with pumping, separating, collecting, treating and/or disposing of water often have a devastating impact on the profit margins, particularly for older wells with declining hydrocarbon production.

Over the years, many attempts have been made to limit the amount of water produced by a well. Down-hole video has been utilized to determine which perforations within the well produce the most oil, and which perforations produce the most water. Chemicals and/or cement may then be utilized in an effort to shut off water producing perforations. One such down-hole video revealed that oil droplets were distinctly separate from the water that was being produced. More importantly, it was recognized that oil and water are typically separated by gravity segregation in the wellbore until they are mixed together by the downhole pump.

In order to capitalize on this phenomena, the Dual Action Pumping System ("DAPS") was developed wherein a dual ported, dual plunger rod pump produced oil and water from the annulus on the upstroke while injecting water on the down stroke. In many suitable wells DAPS have substantially increased production while simultaneously reducing power requirements.

SUMMARY OF THE INVENTION

In accordance with teachings of the present invention an improved method and apparatus for down-hole oil/water separation during pumping operations is provided to substantially improve hydrocarbon production as compared to prior down-hole oil/water separating pumps.

One embodiment of the present invention includes a conventional sucker rod pump disposed within a tubing string which may be disposed within the casing of a wellbore. The sucker rod pump may be releasably attached to a sucker rod at one end. The sucker rod pump may have a single ball and seat type traveling valve with the bottom check valve or standing valve removed.

In another embodiment, the casing may also contain a plurality of injection perforations which may be spaced down-hole from a plurality of production perforations. A packer may be located in a down-hole position between the production perforations and the injection perforation. The packer may circumferentially surround the tubing string to form a fluid seal within the annulus between the casing string and the tubing string.

In yet another embodiment, a side intake valve may be disposed within the tubing string at a position down-hole from the sucker rod pump. The side intake valve may also be disposed at an elevation above the packer and above the production perforations.

In still another embodiment, a check valve may be located within the tubing string at a position down-hole from the sucker rod pump. The check valve is preferably disposed at an elevation below the side intake valve. In one embodiment, the check valve may be of the gravity operated type. In another embodiment, the check valve may be of the spring-loaded type.

In yet another embodiment, the sucker rod may be attached to a standard pumping jack located at the surface of the wellbore. The tubing string may be attached to production piping at the surface of the wellbore. In one embodiment, the production piping may be configured to form a bypass loop. The bypass loop may further contain a check valve to regulate the direction of flow of the produced fluid. An automatic control valve may also be located within the bypass loop to allow the produced fluid to bypass the check valve. A back pressure regulator may be installed within the production piping on the side of the bypass loop opposite the wellbore. In one embodiment, an accumulator may also be connected to the production piping between the bypass loop and the back pressure regulator.

Technical advantages of the present invention include providing a sucker rod pump for down-hole oil/water segregation during pumping operations. In particular, the apparatus of the present invention may separate oil and water in the tubing string and/or the annulus between the tubing string and the casing. This allows the apparatus to produce oil with a limited amount of water to the surface of the well while injecting water back into the formation, during pumping operations.

Another technical advantage of the present invention includes the simplicity and compactness of its design. This permits the apparatus to operate utilizing standard downhole well equipment with minor modifications. Accordingly, downhole equipment incorporating teachings of the present invention can be built and maintained at a reduced cost and operators require very minimal training. Furthermore, this apparatus is not limited in application and can be incorporated into any standard-sized casing or tubing string.

Yet another technical advantage of the present invention includes the injection pressure supplied by the accumulator located at the well surface. There is no pressure limit for this pump because high pressure wells can be counteracted by raising the pressure in the accumulator thereby increasing the injection pressure.

Further technical advantages of the present invention include providing a pump which eliminates the problem of gas-lock which occurs in dual-plunger pumping systems. Furthermore, the present invention provides a pumping system which minimizes or eliminates the injection of oil into the formation when the upper pump has "pumped off."

BRIEF DESCRIPTION OF THE DRAWINGS

For a more complete understanding of the present invention, and the advantages thereof, reference is now made to the following brief descriptions, taken in conjunction with the accompanying drawings and detailed description, wherein like reference numerals represent like parts, in which.

DETAILED DESCRIPTION OF THE INVENTION

The preferred embodiments of the present invention and its advantages are best understood by referring now in more detail to FIGS. 1–6 of the drawings, in which like numerals refer to like parts.

Figure 1:
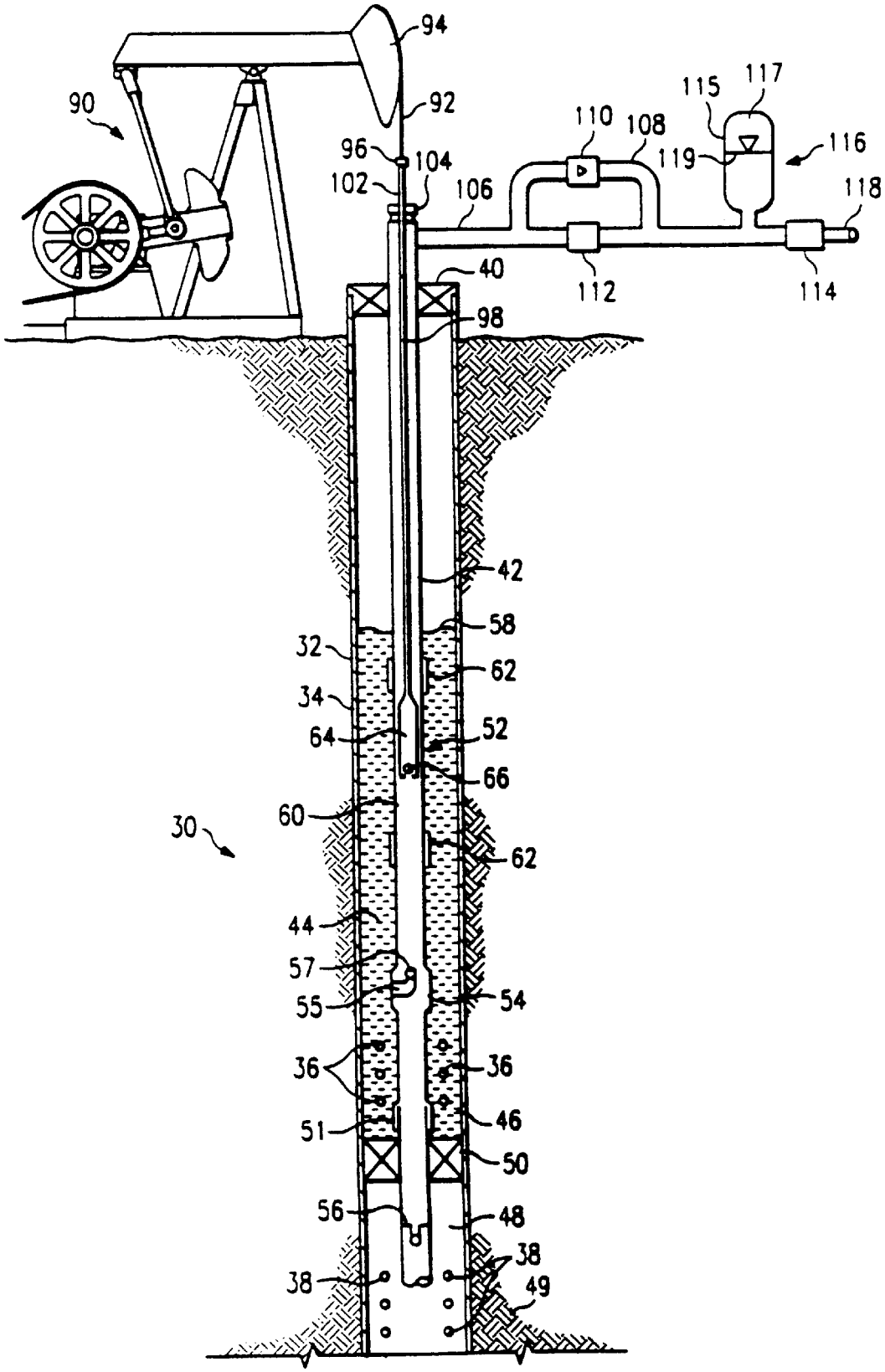
FIG. 1 is a schematic drawing in section and in elevation with portions broken away which show a hydrocarbon producing well having equipment incorporating teachings of the present invention.

Referring to FIG. 1, a diagrammatic cut away side view of a well 30 is illustrated. Well 30 may be used for the production of hydrocarbons, but equipment incorporating teachings of the present invention is also suitable for use with other types of wells.

Well 30 includes a wellbore 32, having a casing 34 cemented therein. Casing 34 preferably contains a plurality of production perforations 36 and plurality of injection perforations 38. A tubing hanger 40 is secured to casing 34 at the surface of wellbore 32. Tubing hanger 40 is releasably connected to tubing string 42 thereby securing tubing string 42 in place within casing 34. Casing 34 and tubing string 42 together form annulus 44. A packer 50 circumferentially surrounds tubing string 42 thereby partitioning annulus 44 into upper annulus 46 and lower annulus 48. Packer 50 preferably includes one or more expandable elements to form a fluid barrier within annulus 44 between tubing string 42 and casing 34. When packer 50 is run into a preselected position, it can be expanded mechanically, hydraulically, or by another means against tubing string 42 and casing 34. In one embodiment of the present invention, an on-off tool 51 may be provided at the transition between packer 50 and tubing string 42. On-off tool 51 allows tubing string 42 to be repeatedly removed from and inserted into packer 50 without dislodging and having to reset packer 50 each time. The G-6 Packer with an XL ON-OFF tool as manufactured by Dresser Oil Tools, a division of Dresser Industries, Incorporated, Dallas, Tex., is suitable for use within the teachings of the present invention.

A standard surface pumping jack 90 may be installed at the surface of wellbore 32. A steel cable or bridle 92 extends from horsehead 94 of pumping jack 90. Bridle 92 is coupled to a polished rod 102 by a standard carrier bar 96. At a position further down-hole, polished rod 102 is coupled with sucker rod 98. In one embodiment of the present invention, sucker rod 98 includes steel rods that are screwed together to form a continuous "string" that connects sucker rod pump 52 inside of tubing string 42 to pumping jack 90 on the surface of well 30.

As illustrated in FIG. 1, polished rod 102 is approximately thirty-three feet in length. Polished rod 102 may also be provided at varying lengths within the teachings of the present invention. A stuffing box 104 is provided at the top of tubing string 42 in order to seal the interior of tubing string 42 and prevent foreign matter from entering. Stuffing box 104 is essentially a packing gland or chamber to hold packing material (not shown) compressed around a moving pump rod or polished rod 102 to prevent the escape of gas or liquid. Polished rod 102 provides a smooth transition at stuffing box 104 and allows for polished rod 102 to operate in an upward and downward motion without displacing stuffing box 104 or tubing string 42.

A sucker rod pump 52 is secured at one end to sucker rod 98. Sucker rod pump 52 may be of the conventional type requiring only that the lower ball and seat valve be removed prior to operation of the pump. Part number 25-175-TH-20-4-2 as specified by the American Petroleum Institute's specification 11AX, with the standing valve ball removed, is suitable for use within the teachings of the present invention. Sucker rod pump 52 includes a barrel 60 which is secured thereto, thereby becoming an integral part of, tubing string 42 with threaded collars 62. Sucker rod pump 52 also includes a movable piston 64. Barrel 60 remains stationary and connected to tubing string 42 during operation of sucker rod pump 52. When pumping jack 90 is activated, movable piston 64 is forced upward and downward through barrel 60 creating a low pressure within barrel 60 and tubing string 42. A traveling valve 66 is provided at the down-hole end of movable piston 64. Within one embodiment of the present invention, traveling valve 66 may be a check valve of the single ball and seat type. Traveling valve 66 is configured to allow flow of fluid through traveling valve 66 in an uphole direction only. Fluid is prevented from traveling through traveling valve 66 in a down-hole direction.

Sucker rod pump 52 of FIG. 1 is preferably a standard tubing pump wherein barrel 60 is integral with tubing string 42. In an alternative embodiment of the present invention, sucker rod pump 52 may be provided as a standard American Petroleum Institute (API) rod pump wherein the entire pump including the barrel is run within tubing string 42 by attached sucker rod 98.

A side intake valve 54 is installed within tubing string 42 at a location down-hole from sucker rod pump 52. Side intake valve 54 may also be positioned above packer 50. Side intake valve 54 includes inlet port 55 and check valve 57. Inlet port 55 allows fluid within annulus 44 to enter tubing string 42. Check valve 57 permits the flow of fluid from annulus 44 into tubing string 42 but prevents flow in the opposite direction. In the embodiment of the present invention illustrated in FIG. 1, side intake valve 54 is positioned approximately two standard tubing string lengths, or sixty six feet above packer 50. While side intake valve 54 may also be positioned at a higher or lower elevation with respect to packer 50, it is often preferable to place side intake valve 54 in close proximity to packer 50. Placing side intake valve 54 a larger distance away from packer 50 may allow a significant amount of sand and debris to accumulate between side intake valve 54 and packer 50. This may cause damage to tubing string 42 during removal from casing 34. Side intake valves suitable for use within the teachings of the present invention will be described later in more detail.

An injection valve 56 may be attached to tubing string 42 at a point down-hole from packer 50. Injection valve 56 isolates the interior of tubing string 42 from lower annulus 48. Injection valve 56 is configured to allow flow from the interior of tubing string 42 into lower annulus 48, but will prevent flow from lower annulus 48 into the interior of tubing string 42.

Injection valve 56 may be provided as a standard check valve with tubing threads for connection to tubing string 42 which prevents backflow of water from injection zone 49 surrounding lower annulus 48 during the lifting cycle. The location of injection valve 56 with respect to sucker rod pump 52 is generally not critical provided injection valve 56 is situated below sucker rod pump 52. Injection valve 56 should be installed below inlet port 55. The distance between sucker rod pump 52 and injection valve 56 can range from a few feet to over one thousand feet.

Injection valve 56 may be provided as a standard gravity actuated check valve. In an alternative embodiment, a spring loaded check valve may be required to supply back pressure to tubing string 42 to prevent the hydrostatic pressure within tubing string 42 from exceeding the pressure required to inject water through injection valve 56 and into injection zone 49.

At an elevation above tubing hanger 40, production piping 106 extends from tubing string 42. Production piping 106 allows communication of fluid from tubing string 42 to a surface collection point (not expressly shown). A bypass loop 108 extends from production piping 106. A check valve 110 is provided within bypass loop 108 and governs the direction of flow of fluids through bypass loop 108. One embodiment of the present invention may incorporate a CV-200 check valve as manufactured by Hydroseal.

An automatic control valve 112 is installed within production piping 106 allowing fluids within production piping 106 to bypass check valve 110 and bypass loop 108 when control valve 112 is in the "open" position. A timer switch (not expressly shown) may also be incorporated to control the opening and closing of automatic control valve 112, at specified time intervals. Electric Valve #31460-WP as manufactured by Atkomatic with a timer switch CX100A6 as manufactured by Eagle Signal may be incorporated within the teachings of the present invention.

An adjustable back pressure regulator 114 regulates the pressure within production piping 106 and an accumulator 116 is attached to production piping 106 between bypass loop 108 and back pressure regulator 114. Pressure Regulator #7702 as manufactured by Baird is suitable for use within the teachings of the present invention. Accumulator 116 maintains sufficient injection pressure to prevent traveling valve 66 from opening when automatic control valve 112 is in the "open" position. The pressure within accumulator 116 may be maintained by injecting nitrogen gas 117 into bladder 115. The level of produced fluid within accumulator 116 is denoted by reference numeral 119. An accumulator suitable for use within the teachings of the present invention is PN 831615 as manufactured by Greer Hydraulics, Inc.

Although the embodiment of the present invention illustrated in FIG. 1 includes a nitrogen charged accumulator, many other types of accumulators are also available for use within the teachings of the present invention. Furthermore, any system capable of supplying and maintaining pressure within production piping 106 may be utilized interchangeably with accumulator 116.

During the operation of well 30, a mixture of oil, water and other fluids will typically enter upper annulus 46 through production perforations 36 to a fluid level 58 within tubing string 42, as illustrated in FIG. 1. The fluid level will depend on several factors such as formation pressure and formation fluid flow rates. Side intake valve 54 is preferably secured into a position below fluid level 58 allowing a mixture of oil and water to be drawn through inlet port 55 and into intake valve 54 to the interior of tubing string 42. The oil and water mixture within tubing string 42 and barrel 60 will begin to separate as the lighter oil droplets float toward the top and the water settles toward injection valve 56.

Pumping jack 90 forces movable piston 64 up and down within barrel 60. When piston 64 moves upward toward the surface of wellbore 32, traveling valve 66 prevents fluid located above piston 64 from moving to a down-hole location. This creates a low pressure effect down-hole from piston 64 thereby forcing fluid within upper annulus 46 to flow through side intake valve 54 and into the interior of tubing string 42. When piston 64 is forced downward through barrel 60 traveling valve 66 will open allowing fluid to travel uphole from piston 64 where it will become trapped by traveling valve 66. By continuing this operation, all of the fluid within upper annulus 46 can be produced to the surface of well 30 and into production piping 106.

Unfortunately, the oil and water mixture within upper annulus 46 may contain a large proportion of water. Conventional pumping operations require that all of the water contained within this oil water mixture be pumped to the surface, separated, collected, treated and/or disposed of which has a negative impact on production costs. In order to overcome this, the present invention provides an apparatus and a method whereby water is disposed of below the well surface prior to pumping and an oil and water mixture containing a much higher proportion of oil to water is produced at the well surface. The teachings of the present invention may also be used to dewater a gas well. The present invention capitalizes on the rapid gravity segregation of oil and water which occurs within tubing string 42 below the surface of the well.

The piping and equipment at the surface of well 30 provide a mechanism by which water within the oil and water mixture can be disposed of prior to production. When automatic control valve 112 is in the "closed" position, all fluid produced from well 30 through tubing string 42 and into production piping 106 must travel through piping loop 108 and check valve 110. Check valve 110 allows fluid to flow from well 30 toward accumulator 116 and will prevent the flow of fluid in the opposite direction. Back pressure regulator 114 is set to maintain a preselected minimum back pressure within production piping 106 between automatic control valve 112 and back pressure regulator 114. This allows accumulator 116 to fill with fluid thereby maintaining pressure within production piping 106. The back pressure provided by nitrogen gas 117 within accumulator 116 can be maintained at a level sufficient to seal traveling valve 66 in the "closed" position when automatic control valve 112 is in the "open" position.

When automatic control valve 112 is in the "closed" position, sucker rod pump 52 will operate as follows. During the upstroke of surface pumping jack 90, oil and water enter tubing string 42 through side intake valve 54. The oil tends to float on the more dense water inside tubing string 42. As fluid is produced to the surface, it bypasses automatic control valve 112 and travels through check valve 110. In this manner, accumulator 116 is charged and back pressure regulator 114 releases excess fluid to a flow line 118. During the downstroke of pumping jack 90, there is not enough pressure on injection valve 56 to force fluid from the interior of tubing string 42 through injection valve 56. The reason the pressure is too low to inject water through injection valve 56 is that automatic control valve 112 isolates tubing string 42 from the pressure of accumulator 116. Accordingly, piston 64 moves down-hole with traveling valve 66 in the "open" position, thereby collecting fluid above piston 64, similar to a conventional rod pump.

When automatic control valve 112 is open, sucker rod pump 52 will operate as follows. During the upstroke of pumping jack 90, oil and water enter tubing string 42 through side intake valve 54. Once again, the oil tends to float toward the surface as the more dense water settles downward toward packer 50 inside tubing string 42. At the surface of well 30, produced fluid flows through both automatic control valve 112 and check valve 110. Accumulator 116 is charged and back pressure regulator 114 releases excess produced fluid to flow line 118. On the downstroke of pumping jack 90, the pressure above piston 64 is greater than the pressure below piston 64 which causes traveling valve 66 to remain in a "closed" position. Since the hydrostatic pressure of fluid within tubing string 42 coupled with the pressure supplied by accumulator 116 is higher than the pressure required to inject water through injection valve 56, water located at the bottom of tubing string 42 will be forced through injection valve 56 and subsequently travel through injection perforations 38 to an underground position within injection zone 49. Little or no oil is injected into injection valve 56 because the oil and water separate inside tubing string 42 between piston 64 and injection valve 56. The lighter oil floats on water. On the next upstroke, fluid is not produced to the surface because there is a one-stroke vacancy inside the tubing that is replaced by this stroke. The operation of automatic control valve 112 determines the ratio of fluid produced to the surface to the fluid injected through injection valve 56. For example, if automatic control valve 112 is preset to open for nine strokes of pumping jack 90 and closed for one, nine volumes (90%) of water will be injected through injection valve 56 for every one (10%) volume of fluid produced to the surface of well 30.

As discussed previously, a spring loaded injection valve may be required in low pressure wells in order to create back pressure within tubing string 42. This back pressure is required to maintain the level of fluid within tubing string 42 and other pumping equipment. Back pressure regulator 114 is set to be at least as high as the injection pressure of the injection zone minus the hydrostatic pressure of fluid within tubing string 42. Accumulator 116 is sized to accommodate a minimum of one displaced volume of sucker rod pump 52. When automatic control valve 112 is closed, the pumping action is similar to a conventional sucker rod pump. When automatic control valve 112 is open, the pump will not produce any fluid to the surface but it will inject fluid through injection valve 56 into injection zone 49. The ratio of fluid produced to fluid injected is equal the percentage of time that the control valve is closed.

Figure 1A:
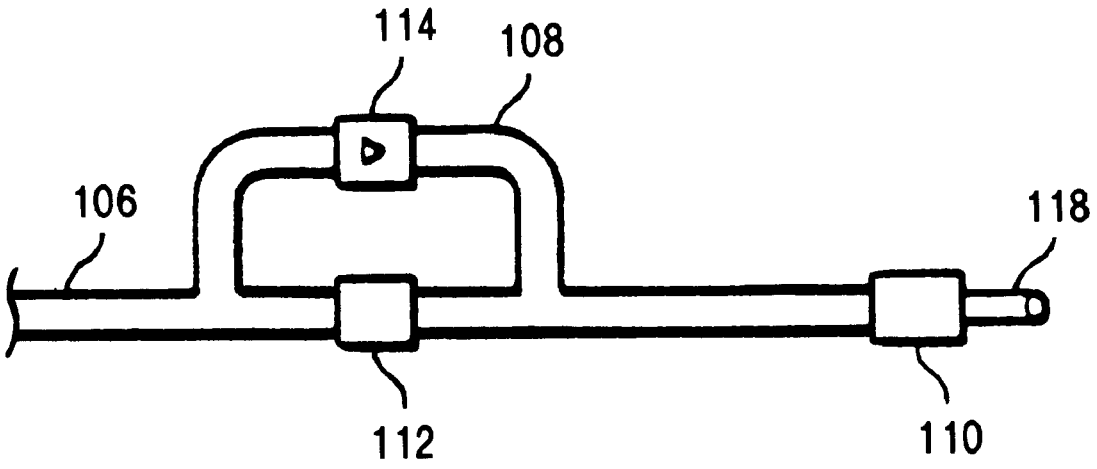
FIGS. 1A and 1B are schematic diagrams of alternate configurations of surface pumping equipment for use with the well of FIG. 1.
Figure 1B:
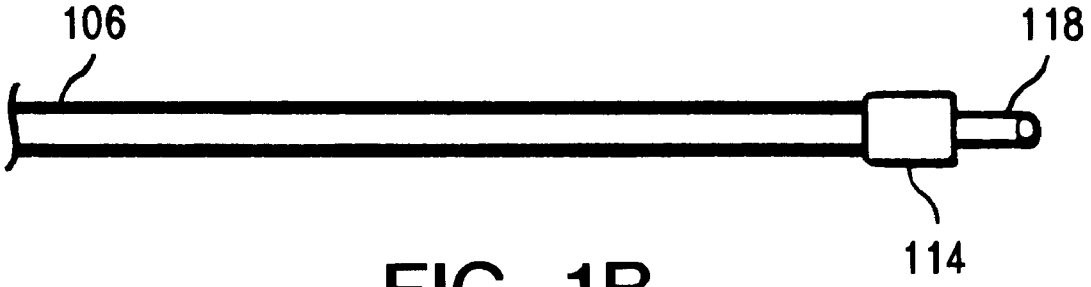

FIGS. 1A and 1B illustrate alternative configurations of surface pumping equipment available for use with the well of FIG. 1. For some applications (i.e. "low pressure" wells), the accumulator 116 is not required.

When the surface equipment associated with production piping 106 is configured in accordance with FIG. 1A, the well can be operated in at least two distinct modes. The first mode is available when automatic control valve 112 is closed. Automatic control valve 112 is not required and the first mode of operation may be accomplished when automatic control valve is not installed (See FIG. 1B).

During the first mode of operation, on the upstroke water and oil are pulled in through side intake valve 54 into tubing string 42. This causes water and oil within production piping 106 to be forced through back pressure regulator 114, bypassing automatic control valve 112 (see FIG. 1A). The amount of water and oil displaced within tubing string 42 is equal to volume of oil and water displaced by moveable piston 64. The amount of oil and water forced through production piping 106 will equal the amount of oil and water displaced by moveable piston 64 reduced by the amount of water and oil displaced due to the movement of polished rod 102. On the downstroke polished rod 102 displaces water and oil from tubing string 42 causing the water and oil to be expelled from the tubing string at the location that requires the least pressure. In other words, the water and oil will follow the path of least resistance, out of tubing string 42. Back pressure regulator 114 may be adjusted to force this water and oil to be expelled through the lower end of tubing string 42 at injection valve 56. The water and oil mixture at the lower end of tubing string 42 is predominantly, and in the best case scenario entirely, water. Therefore, during this mode of operation, water is expelled through injection valve 56 into injection zone 49, on the downstroke of moveable piston 64. In this mode of operation, the ratio of fluid produced to the surface of the well to fluid disposed of at injection zone 49 will equal the difference between the amount of fluid displaced by moveable piston 64 and the amount of fluid displaced by polished rod 102 divided by the amount of fluid displaced by polished rod 102.

During the second mode of operation, automatic control valve 112 is open and all fluid produced to the surface of the well will bypass back pressure regulator 114 through production piping 106 (see FIG. 1A). During this operation, back pressure regulator 114 does not supply pressure within tubing string 42 as it does during the operation described in the first mode above. On the upstroke of moveable piston 64, water and oil enter tubing string 42 through side intake valve 54. This forces fluid through automatic control valve 112 into flow line 118. The amount of fluid that enters flow line 118 will equal the amount of fluid displaced by moveable piston 64 minus the amount of fluid displaced by polished rod 102. On the downstroke of moveable piston 64, polished rod 102 displaces fluid from tubing string 42 which must be expelled from tubing string 42. The expelled fluid will follow the path of least resistance and exit tubing string 42 at the point of least pressure. Since automatic control valve 112 is open, the expelled fluid will travel through automatic control valve 112 into flow line 118. In the second mode of operation, fluid will be produced to the surface of the well at flow line 118, and no fluid will be injected into injection zone 49. A timing device can be utilized to control the opening of automatic control valve 112 at preset intervals in order to achieve various ratios of fluid produced to the surface of the well at flow line 118 to fluid injected into injection zone 49 through injection valve 56. Any device which will control the opening and closing of automatic control valve 112 is suitable for use within the teachings of the present invention. Check valve 110 of FIG. 1A is optional and provides a mechanism to control the flow of fluid through production piping 106.

FIG. 1B illustrates an alternative configuration of surface equipment suitable for use with the well of FIG. 1, within the teachings of the present invention. This configuration may be utilized by a well operator when the ambient conditions at the well render the use of an accumulator and an automatic control valve unnecessary.

Figure 6:
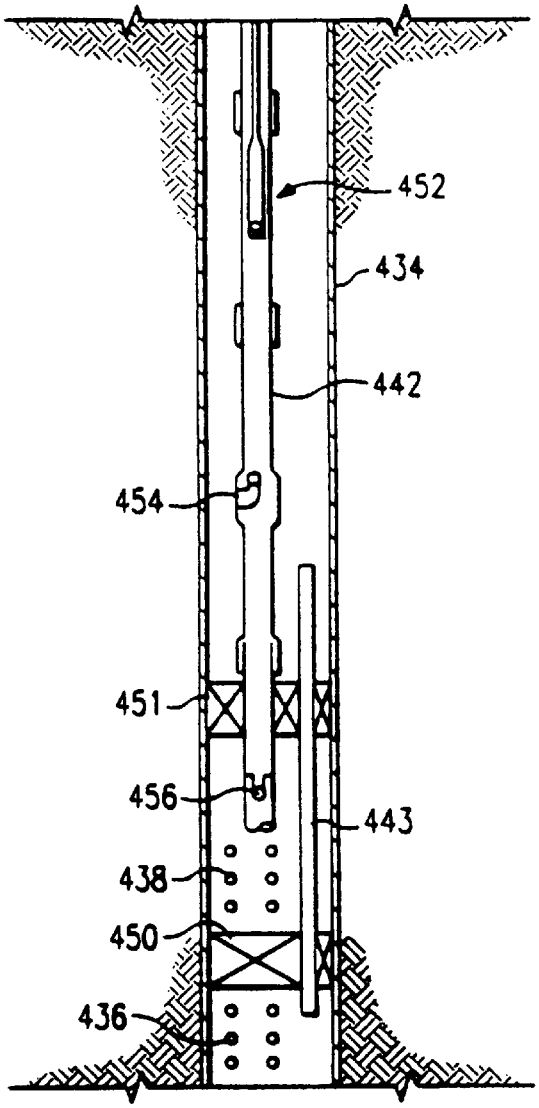
FIG. 6 is a schematic drawing in section and in elevation with portions broken away showing the down-hole portion of a well incorporating an alternative embodiment of the present invention.
Figure 5:
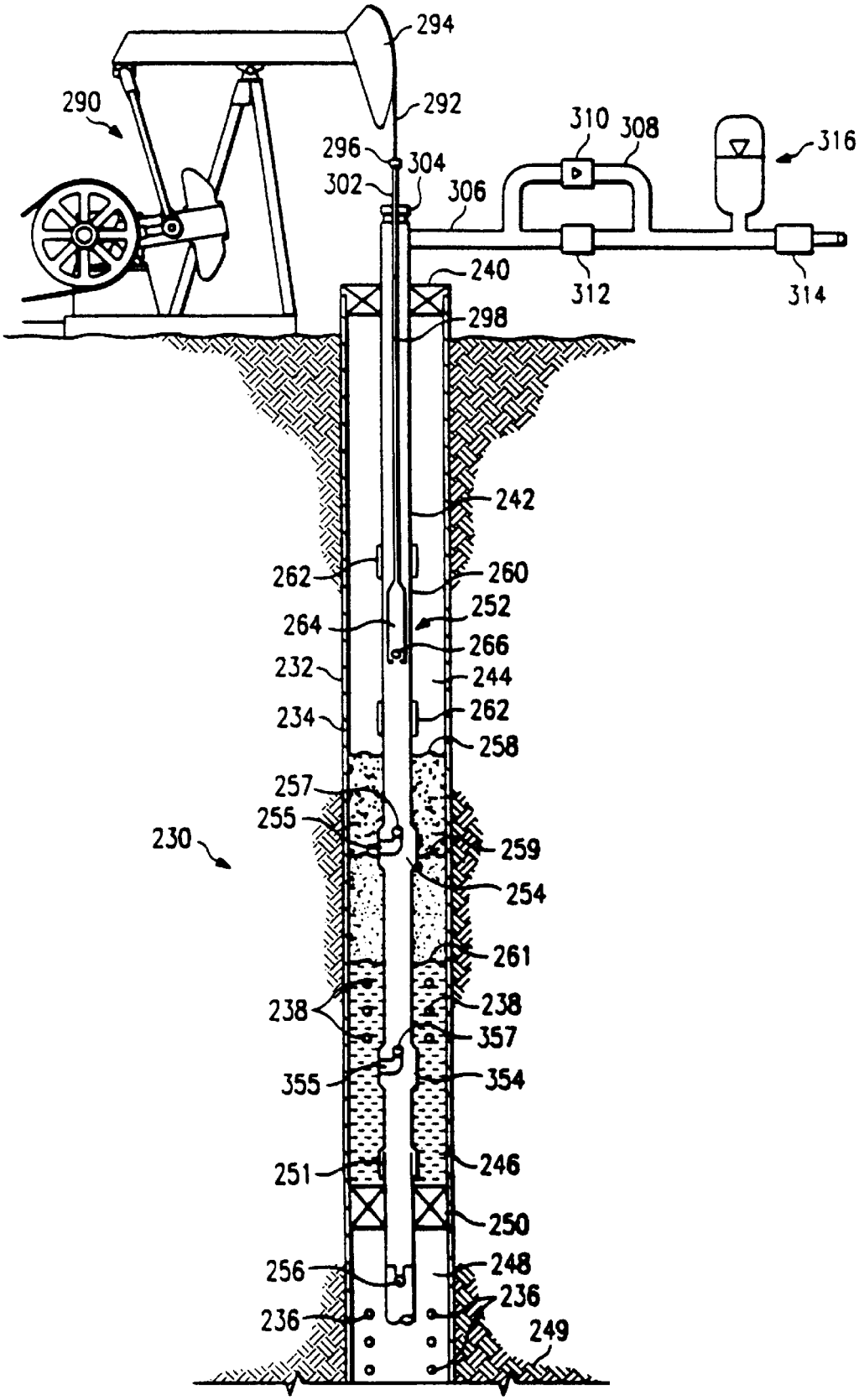
FIG. 5 is a schematic drawing in section and in elevation with portions broken away showing a hydrocarbon producing well having equipment representing an alternative embodiment of the present invention.

Although the surface equipment configurations represented in FIGS. 1A and 1B have been illustrated and described for use with the well of FIG. 1, they are equally applicable to any other well configuration, including those shown and described in FIGS. 5 and 6.

One advantage of the present invention includes its incorporation of a standard sucker rod pump. Accordingly, the size of the pump does not limit the application. The present invention may be practiced within any casing size accessible by conventional sucker rod pumps. Many, of the prior attempts to separate oil and water at a down-hole location have required a larger specially designed pump which was not appropriate in smaller casing sizes. Furthermore, there is no pressure limit inherent within the teachings of the present invention since any down-hole pressure can generally be overcome by increasing the pressure of nitrogen gas 117 of accumulator 116, thereby charging production piping 106 and tubing string 42 with back pressure sufficient to overcome any pressure experienced down-hole.

The configuration of surface equipment illustrated in FIG. 1 allows for great versatility in fluid production. The injection to production ratio of this system is controlled by the operator from the surface of the well and is determined by the timing of automatic control valve 112. Furthermore, the configuration of equipment illustrated in FIG. 1 allows oil and water to be separated within tubing string 42 rather than annulus 44.

Although oil and water separation have been described and illustrated in conjunction with FIG. 1, the teachings of the present invention may also be utilized to de-water a gas well. The operation of a gas well would include gas entering well 30 through perforations 36. As water and hydrocarbons accumulate, fluid level 58 will rise. The additional pressure within casing 42 caused by the rising fluid level 58 makes it difficult to collect gas which accumulates in annulus 44. By disposing of water into injection zone 49, gas can be more easily collected at the surface of the well. Gas which accumulates within annulus 44 would typically be collected at tubing hanger 40, by installing gas collection piping (not expressly shown).

Figure 2:
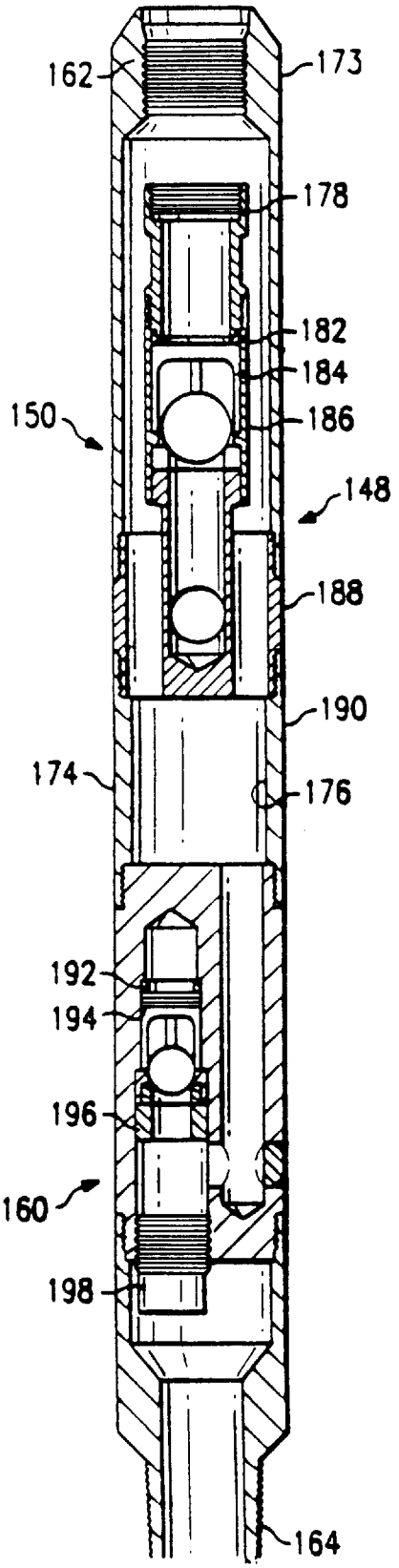
FIG. 2 is a schematic drawing in section of a side intake valve and injection valve incorporating teachings of the present invention.
Figure 3:
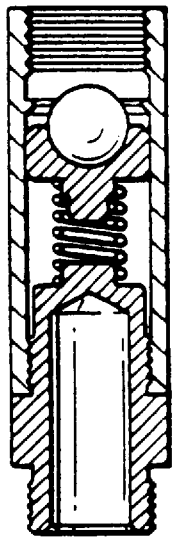
FIG. 3 is a schematic drawing in section showing an alternative embodiment of the injection valve of FIG. 2.

Referring now to FIG. 2, a side intake valve 150 and injection valve 160 suitable for use within the teachings of the present invention are shown. As illustrated by FIG. 2, side intake valve 150 and injection valve 160 may be provided within an integral valve assembly 148 suitable for connection to a tubing string (not expressly shown) at threaded connections 162 and 164. Side Intake/Bottom Discharge Valve PN-147372 as manufactured by Dresser Oil Tools, a division of Dresser Industries, Dallas, Tex., is suitable for use within the teachings of the present invention. Injection valve 160, as illustrated in FIG. 2, is a bottom discharge gravity actuated check valve suitable for use in high pressure injection zones. An alternative embodiment is illustrated by injection valve 161 illustrated in FIG. 3. Injection valve 161 provides a spring loaded bottom discharge injection valve suitable for use within low pressure injection zones. Injection valve 161 may be utilized to prevent unwanted "runaway" injection caused by the low pressure below injection valve 161.

Valve assembly 148 includes a side intake injection valve 150 and a bottom discharge injection valve 160. Valve assembly 148 also includes an upper nipple 173 suitable for threadable connection to a tubing string (not expressly shown). A cage bushing 178 is provided within side intake injection valve 150. A compression ring 182 is provided around cage insert 184 sealing the gap around the circumference of cage insert 184. A cage body 186 secures a side intake body 188 in place within valve assembly 148. Side intake body 188 allows the communication of fluid outside valve assembly 148 through side intake body 188 into valve assembly 148. A lower nipple 190 is provided to connect the side intake valve 150 portion of valve assembly 148 to the bottom discharge injection valve 160 portion of valve assembly 148.

Bottom discharge injection valve 160 of valve assembly 148 includes a ring compression bushing 192 surrounding a caged compression ring 194. Plug seat 196 and plug 198 provide a mechanism by which bottom discharge injection valve 160 may regulate the direction of flow of fluid through injection valve 160 by preventing fluid from entering the interior of valve assembly 148 through injection valve 160.

Figure 4:
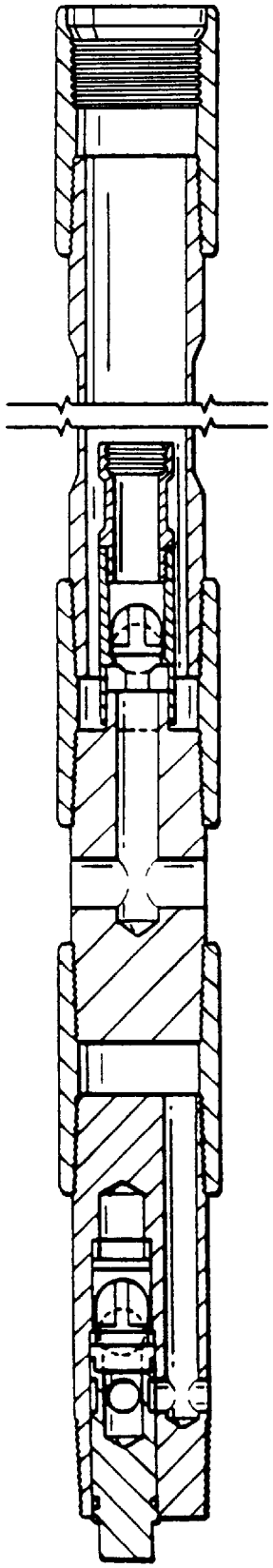
FIG. 4 is a schematic drawing in section with portions broken away showing an alternative embodiment of the side intake valve and injection valve of FIG. 2.

An alternative embodiment of the valve assembly of FIG. 2 is illustrated in FIG. 4.

Referring now to FIG. 5, an alternative embodiment of the present invention is illustrated. A diagrammatic cut away side view of a well 230 includes a wellbore 232, having a casing 234 cemented therein. Casing 234 contains a plurality of production perforations 236 and plurality of injection perforations 238. A tubing hanger 240 is secured to casing 234 at the surface of wellbore 232. Tubing hanger 240 is releasably connected to tubing string 242, thereby securing tubing string 242 in place within casing 234. Casing 234 and tubing string 242 together form annulus 244. A packer 250 circumferentially surrounds tubing string 242 thereby partitioning annulus 244 into upper annulus 246 and lower annulus 248. Packer 250 is an expanding plug used to seal off 244 annulus between tubing string 242 and casing 234. On-off tool 251 allows tubing string 242 to be repeatedly removed from and inserted into packer 250 without having to reset packer 250 each time. A standard surface pumping jack 290 is installed at the surface of wellbore 232. A steel cable or bridle 292 extends from horsehead 294 of pumping jack 290. Bridle 292 is coupled to a polished rod 302 by a standard carrier bar 296. At a position further down-hole, polished rod 302 is coupled with sucker rod 298.

A stuffing box 304 is provided at the top of tubing string 242 in order to seal the interior of tubing string 242 and prevent foreign matter from entering. Stuffing box 304 is essentially a packing gland or chamber to hold packing material (not shown) compressed around a moving pump rod or polished rod 302 to prevent the escape of gas or liquid.

A sucker rod pump 252 is secured at one end to sucker rod 298. Sucker rod pump 252 may be of the conventional type requiring only that the lower ball and seat valve be removed prior to operation of the pump. Sucker rod pump 252 includes a barrel 260 which is secured to, thereby becoming an integral part of, tubing string 242 with threaded collars 262. Sucker rod pump 252 also includes a movable piston 264. Barrel 260 remains stationary and connected to tubing string 242 during operation of sucker rod pump 252. When pumping jack 290 is activated, movable piston 264 is forced upward and downward through barrel 260 creating a partial vacuum within barrel 260 and tubing string 242. A traveling valve 266 is provided at the down-hole end of movable piston 264. Traveling valve 266 is configured to allow flow of fluid through traveling valve 266 in an uphole direction only. Fluid is prevented from traveling through traveling valve 266 in a down-hole direction.

A first side intake valve 254 is installed within tubing string 242 at a location down-hole from sucker rod pump 252. Side intake valve 254 includes inlet port 255 and check valve 257. Inlet port 255 allows fluid within annulus 244 to enter tubing string 242. Check valve 257 permits the flow of fluid from annulus 248 into tubing string 242 but prevents flow in the opposite direction.

A second side intake valve 354 is installed within tubing string 242 at a location down-hole form side intake valve 254. Side intake valve 354 includes inlet port 355 and check valve 357. Inlet port 355 allows fluid within annulus 244 to enter tubing string 242. Check valve 357 permits the flow of fluid from annulus 248 into tubing string 242 but prevents flow in the opposite direction.

An injection valve 256 is attached to tubing string 242 at a point down-hole from side intake valve 354. Injection valve 256 isolates the interior of tubing string 242 from lower annulus 248. Check valve 256 is configured to allow flow from the interior of tubing string 242 into lower annulus 248, but will prevent flow from lower annulus 248 into the interior of tubing string 242. Check valve 256 prevents backflow of water from injection zone 249 surrounding lower annulus 248 during the lifting cycle.

At an elevation above tubing hanger 240, production piping 306 extends from tubing string 242. Production piping 306 allows communication of fluid from tubing string 242 to the ultimate surface collection point (not expressly shown). A bypass loop 308 extends from production piping 306. A check valve 310 is provided within bypass loop 308 and governs the direction of flow of fluids through bypass loop 308. An automatic control valve 312 is installed within production piping 306 allowing fluids within production piping 306 to bypass check valve 310 and bypass loop 308 when control valve 312 is in the "open" position.

An adjustable back pressure regulator 314 regulates the pressure within production piping 306 and an accumulator 316 is attached to production piping 306 between bypass loop 308 and back pressure regulator 314. Accumulator 316 maintains sufficient injection pressure to prevent traveling valve 266 from opening when automatic control valve 312 is in the "open" position.

During the operation of well 230, an oil and water fluid mixture will enter upper annulus 246 through production perforations 236. The oil and water mixture will fill upper annulus 246 to a level indicated by reference numeral 258. Since water is heavier than oil, the oil and water mixture will tend to separate within the annulus, such that the oil settles near the top and the water is forced down-hole toward packer 250. The fluid between fluid level 258 and fluid level 259 will comprise primarily oil. Further down-hole, an oil water mixture may be present between fluid level 259 and fluid level 261. The fluid between fluid level 261 and packer 250 will comprise primarily water.

Side intake valve 254 is preferably secured into a position between fluid level 258 and 259. Side intake valve 354 is preferably secured into a position between fluid level 261 and packer 250.

Pumping jack 290 forces movable piston 264 up and down within barrel 260. When piston 264 moves upward toward the surface of wellbore 232 traveling valve 266 prevents fluid located above piston 264 from moving to a down-hole location. This creates a partial vacuum effect down-hole from piston 264, thereby forcing fluid within upper annulus 246 through side intake valves 254 and 354 and into the interior of tubing string 242. When piston 264 is forced downward through barrel 260, traveling valve 266 will open allowing fluid within tubing string 242 to travel uphole from piston 264 where it will become trapped by traveling valve 266. By continuing this operation, all of the fluid within upper annulus 246 can be produced to the surface of well 230 and into production piping 306.

The equipment configuration illustrated within FIG. 5 provides an apparatus and a method whereby water is disposed of below the surface prior to pumping and an oil and water mixture containing a much higher proportion of oil to water is produced to the surface. Ideally, there will be no water within the fluid produced to the surface.

Casing 234 and annulus 244 provide a large conduit for the separation of oil and water. During rapid pumping operations, or those in which the separation of oil and water occurs at a slower rate due to low temperatures or other variables, a larger volume will be required to accommodate a more rapid and efficient separation of oil and water.

Providing two side intake valves as illustrated in FIG. 5 accommodates the separation of oil and water within annulus 244 between casing 234 and tubing string 242, and further provides for the separation of oil and water within tubing string 242. The other components indicated within FIG. 5 function in a manner similar to those of FIG. 1.

An alternative embodiment of the downhole equipment configuration of FIG. 1 is illustrated in FIG. 6. This configuration allows the production perforations 436 to be located downhole from the injection perforations 438. This is accomplished by installing a bottom packer 450 at a location within casing 434 between production perforations 436 and injection perforations 438. A second packer 451 is installed within casing 434 at an elevation above injection perforations 438. Packer 450 is configured to accept an elongate bypass tube 443 therethrough. Packer 451 is configured to accept bypass tube 443 and tubing string 442 therethrough. A sucker rod pump 452 may be installed within tubing string 442. A side intake valve 454 and/or an injection valve 456 may also be installed within tubing string 442. Sucker rod pump 452, side intake valve 454, and injection valve 456 may function similarly to those described within the embodiment illustrated within FIG. 1.

The teachings of the present invention allow an oil well operator to reduce costs and power requirements involved with water production, handling, separation and disposal. By separating oil and water at a down-hole location and injecting water into the formation oil production is increased while potential investment costs and water handling costs are decreased. As much as 80% or more of water produced from a well can be injected rather than handled at the surface. With potential water handling costs of $0.10 to $0.50 per barrel and trucking costs ranging from $0.35 bbl to $1.50 bbl, these costs are significant.

Although the present invention has been described by several embodiments, various changes and modifications may be suggested to one skilled in the art. It is intended that the present invention encompasses such changes and modifications as fall within the scope of the present appended claims.

What is claimed is:

1. A well pumping apparatus for separating oil and water during the production of hydrocarbons from a casing within an underground wellbore, the pumping apparatus comprising:

an elongate tubing string having an injection valve at a lower end thereof and a side intake valve spaced upwardly from said lower end, the tubing string suitable for removable insertion into the casing in a lengthwise direction, thereby creating an annulus between the tubing string and the casing;

an elongate rod string coupled with a surface pumping jack, the elongate rod string suitable for removable insertion into the tubing string in a lengthwise direction;

a sucker rod pump with a reciprocating piston slidably disposed therein coupled with a first end of the rod string for removably installing the sucker rod pump at a down-hole location within the tubing string;

a length of production piping with an automatic control valve disposed therein coupled to the tubing string at the surface of the wellbore for communication of fluid from the tubing string to a collection point;

a piping loop with a check valve disposed therein coupled to the production piping at two locations on opposite sides of the automatic control valve for bypassing the automatic control valve;

a back pressure regulator disposed within the production piping between the tubing string and the collection point; and an accumulator coupled with the production piping between the piping loop and the back pressure regulator.

2. The well pumping apparatus of claim 1 further comprising:

a packer installed radially upon the exterior of the tubing string at a preselected downhole location thereby sealing the annulus between the tubing string and the casing.

3. The well pumping apparatus of claim 1 further comprising:

a packer installed radially upon the exterior of the tubing string at a preselected downhole location thereby sealing the annulus between the tubing string and the casing; and a plurality of production perforations through the casing at an elevation above the packer.

4. The well pumping apparatus of claim 1 further comprising:

a packer installed radially upon the exterior of the tubing string at a preselected downhole location thereby sealing the annulus between the tubing string and the casing; and a plurality of injection perforations through the casing at an elevation below the packer.

5. The well pumping apparatus of claim 1 wherein the injection valve further comprises a gravity actuated check valve.

6. The well pumping apparatus of claim 1 wherein the injection valve further comprises a spring loaded check valve.

7. The well pumping apparatus of claim 1 wherein the sucker rod pump further comprises a barrel type sucker rod pump wherein an elongate barrel portion of the sucker rod pump is an integral part of the tubing string.

8. The well pumping apparatus of claim 1 wherein the sucker rod pump further comprises an American Petroleum Institute rod type sucker rod pump wherein an elongate barrel portion of the sucker rod pump is a separate component from the tubing string.

9. The well pumping apparatus of claim 1 wherein the sucker rod pump further comprises a single ball and seat check valve type sucker rod pump.

10. A well pumping apparatus for separating oil and water during the production of hydrocarbons from a casing within an underground wellbore, the pumping apparatus comprising:

an elongate tubing string having an injection valve at a lower end thereof and a first side intake valve spaced upwardly from said lower end, the tubing string suitable for removable insertion into the casing in a lengthwise direction, thereby creating an annulus between the tubing string and the casing;

a second side intake valve spaced upwardly from the first side intake valve;

an elongate rod string coupled with a surface pumping jack, the elongate rod string suitable for removable insertion into the tubing string in a lengthwise direction;

the pumping jack having a first raised position associated with an upstroke motion and a second lowered position associated with a downstroke motion;

a sucker rod pump with a reciprocating piston slidably disposed therein coupled with a first end of the rod string for removably installing the sucker rod pump at a down-hole location within the tubing string;

a length of production piping coupled to the tubing string at the surface of the wellbore for communication of fluid from the tubing string to a collection point;

an automatic control valve disposed within the production piping to regulate the flow of fluid therethrough;

a piping loop coupled to the production piping at two locations on opposite sides of the automatic control valve for bypassing the automatic control valve;

a check valve disposed within the piping loop for regulating the direction of the flow of fluid therethrough;

a back pressure regulator disposed within the production piping between the tubing string and the collection point; and an accumulator coupled with the production piping between the piping loop and the back pressure regulator.

11. A method of separating oil and water during the production of hydrocarbons from a casing within an underground wellbore comprising the steps of:

inserting an elongate tubing string having an injection valve at a lower end thereof and a first side intake valve spaced upwardly from said lower end into the casing in a lengthwise direction, thereby creating an annulus between the tubing string and the casing;

coupling a first end of an elongate rod string with a surface pumping jack, and coupling a second end of the elongate rod string with a sucker rod pump, the sucker rod pump having a reciprocating piston slidably disposed therein;

inserting the sucker rod pump into the tubing string in a lengthwise direction, to a preselected downhole position;

coupling a length of production piping with an automatic control valve and a back pressure regulator disposed therein to the tubing string at the surface of the wellbore;

coupling a piping loop with a check valve disposed therein with the production piping at two locations on opposite sides of the automatic control valve; and installing an accumulator with the production piping at a location between the back pressure regulator and the automatic control valve.

* * * * *